US006394766B1

(12) United States Patent
Gill et al.

(10) Patent No.: US 6,394,766 B1
(45) Date of Patent: May 28, 2002

(54) FAN WITH ADJUSTABLE GUIDE VANES

(75) Inventors: James G. Gill; Martin J. Becker, both of 5539 Riverton Ave., North Hollywood, CA (US) 91601; Dylan H. Hixon, Los Angeles; Thomas S. Costan, Burbank, both of CA (US)

(73) Assignees: James G. Gill; Martin J. Becker, both of Glendale, CA (US)

( * ) Notice: Subject to any disclaimer, the term of this patent is extended or adjusted under 35 U.S.C. 154(b) by 0 days.

(21) Appl. No.: 09/432,051

(22) Filed: Nov. 1, 1999

(51) Int. Cl.[7] ..... F04B 17/00; F04B 35/00; F01B 25/02; F01D 17/12

(52) U.S. Cl. ..... 417/423.1; 417/326; 415/148; 415/159

(58) Field of Search ..... 415/148, 159, 415/151, 150; 416/247 R; 417/326, 423.1

(56) References Cited

U.S. PATENT DOCUMENTS

| | | | | | |
|---|---|---|---|---|---|
| 2,382,913 | A | * | 8/1945 | Robinson | 230/114 |
| 2,985,427 | A | * | 5/1961 | Houghton | 253/55 |
| 3,231,239 | A | * | 1/1966 | Tyler | 253/59 |
| 3,371,855 | A | * | 3/1968 | Bruns | 230/120 |
| 3,450,339 | A | * | 6/1969 | Geoffroy | 230/274 |
| 3,481,534 | A | * | 12/1969 | Price | 230/274 |
| 3,685,921 | A | * | 8/1972 | Dekeyser | 415/159 |
| 4,486,144 | A | | 12/1984 | Hung | 415/121 G |
| 4,521,153 | A | | 6/1985 | Morimoto et al. | 415/146 |
| 5,295,811 | A | * | 3/1994 | Chiu | 417/423.15 |
| 5,347,205 | A | * | 9/1994 | Piland | 318/811 |
| 5,480,282 | A | | 1/1996 | Matson | 415/125 |
| 5,503,526 | A | | 4/1996 | Neils et al. | 416/63 |
| 5,620,301 | A | * | 4/1997 | Lawer | 415/150 |
| 5,622,036 | A | | 4/1997 | Hill | 56/12.8 |

* cited by examiner

*Primary Examiner*—Charles G. Freay
*Assistant Examiner*—Timothy P. Solak
(74) *Attorney, Agent, or Firm*—James Creighton Wray; Meera P. Narasimhan

(57) ABSTRACT

The present invention is a fan with adjustable vanes for controlling the width of the wind generated by the fan. The vanes are adjustable to any angle. Preferably, the vanes are set at 10° with the generated wind for a narrow, focused beam, and to 45° with the generated wind for a diffuse, flood beam. The vanes are adjustable from a dial located on the outside of the fan housing. A motor drives the fan. The motor is controlled by a rotating dial on the outside of the fan housing. The rotating dial allows for adjusting the motor speed from 0 to 100%. Pressing a "burst" button located on the outside of the fan housing instantly provides 100% motor speed. The fan motor runs at full speed for as long as the "burst" button is depressed. A mounting yoke is pivotally connected to opposite sides of the fan housing, allowing the fan to be set at various angles.

16 Claims, 2 Drawing Sheets

FAN WITH ADJUSTABLE GUIDE VANES

BACKGROUND OF THE INVENTION

Currently, fans used to generate wind are large and rather expensive, particularly when used in the special effects industry. A need exists for a more compact, efficient and inexpensive fan that still has a high wind output. A need also exists for a fan that allows a user to control the wind that is generated by the fan.

SUMMARY OF THE INVENTION

The present invention is a fan with adjustable vanes for controlling the width of the wind generated by the fan. The vanes are adjustable to any angle. Preferably, the vanes are set at 10° with the generated wind for a narrow, focused beam, and to 45° with the generated wind for a diffuse, flood beam. When the vanes are set at 10°, the focused beam has a 3.5 foot diameter at ten feet. The velocity of the focused beam (vanes at 10°) at ten feet is 20 mph. When the vanes are set at 45°, the flood beam has an eight foot diameter at ten feet. Using different sized motors in the fan allows for various sized beams to be obtained. The vanes are adjustable from a dial located on the fan housing.

The motor is controlled by a rotating dial on the outside of the fan housing. The rotating dial allows for adjusting the motor speed from 0 to 100%. Pressing a "burst" button located on the outside of the fan housing instantly provides 100% motor speed. The fan motor runs at full speed for as long as the "burst" button is depressed.

A mounting yoke is pivotally connected to opposite sides of the fan housing, allowing the fan to be set at various angles. The fan may also be inverted during transportation so that the fan is protected by the yoke.

These and further and other objects and features of the invention are apparent in the disclosure, which includes the above and ongoing written specification, with the drawings.

DETAILED DESCRIPTION OF THE PREFERRED EMBODIMENTS

Figure 1:
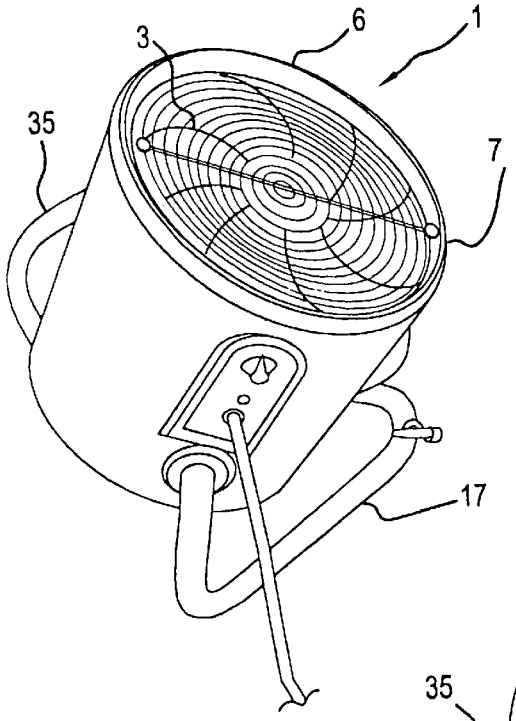
FIG. 1 is a perspective view of the fan device.
Figure 2:
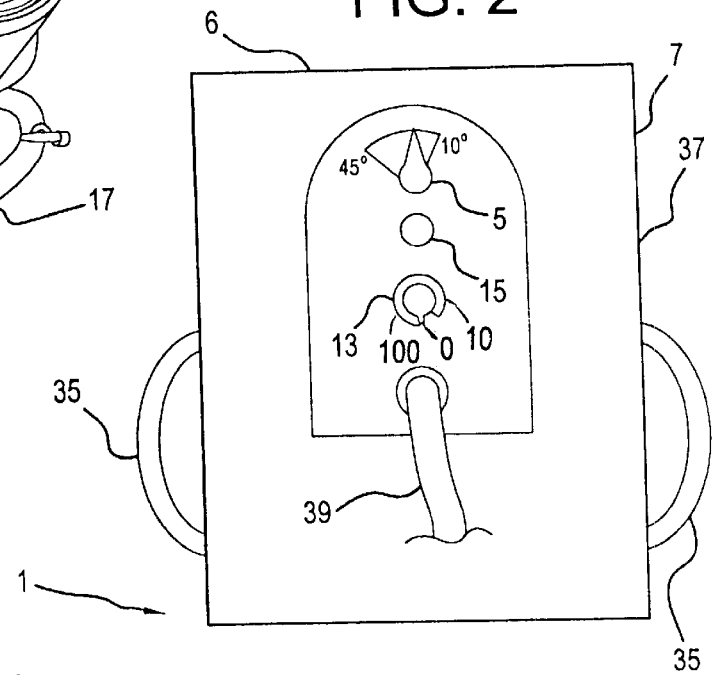
FIG. 2 is a front view of the fan device.
Figure 4:
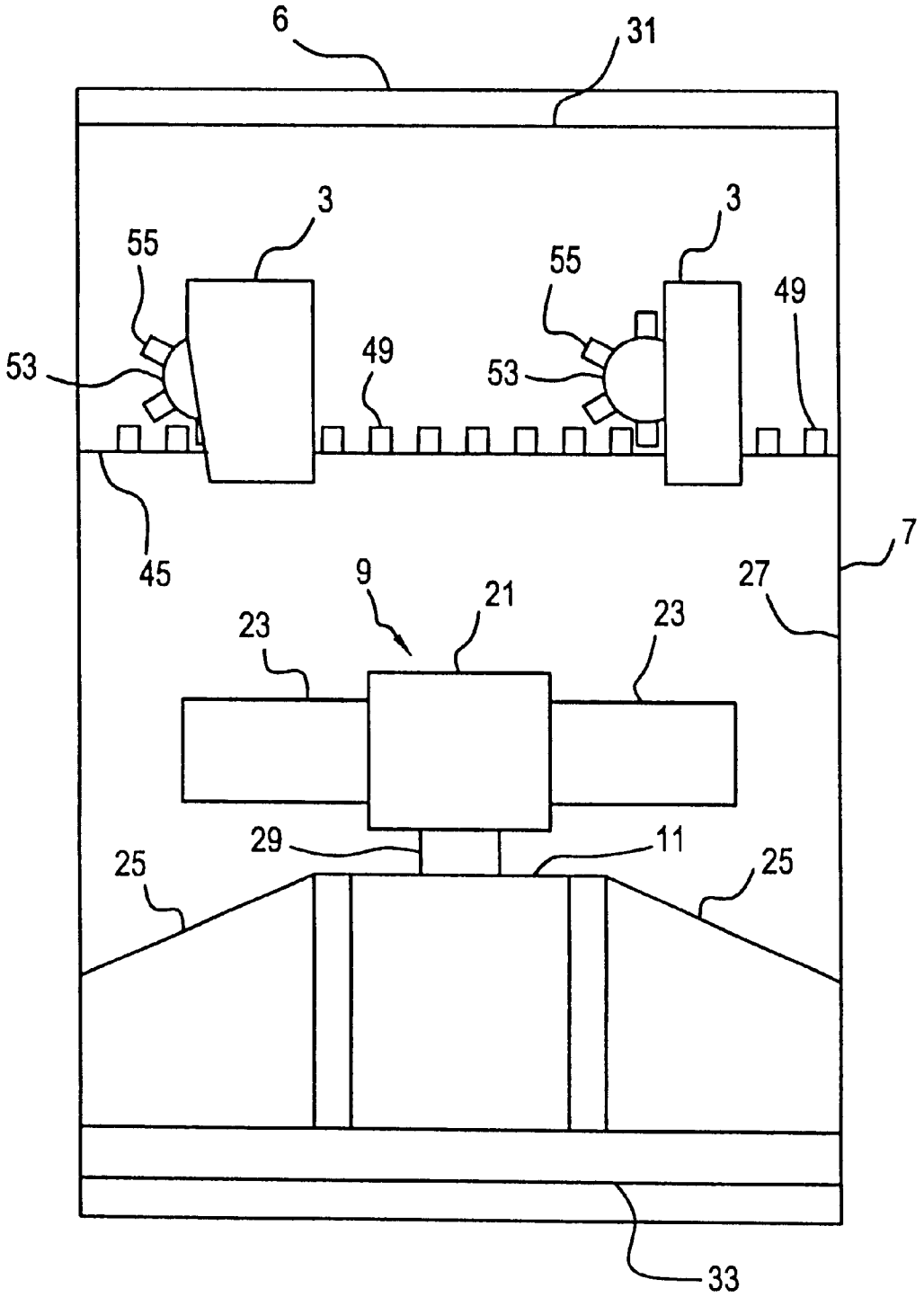
FIG. 4 is a cross-section of the fan device of FIG. 3.

Referring to FIGS. 1, 2 and 4, the present invention is a fan 1 with adjustable vanes 3 for controlling the width of the wind generated by the fan. The vanes 3 are adjustable to any angle. Preferably, the vanes are set at 10° with the generated wind for a narrow, focused beam, and to 45° with the generated wind for a diffuse, flood beam. When the vanes 3 are set at 10°, the focused beam has a 3.5 foot diameter at ten feet from the output end 6 of the fan housing 7. The velocity of the focused beam (vanes at 10°) at ten feet is 20 mph. When the vanes 3 are set at 45°, the flood beam has an eight foot diameter at ten feet from the output end 6 of the fan housing 7. Using different sized motors in the fan allows for various sized beams to be obtained. The vanes 3 are adjustable from a controller, such as a dial 5, located on the fan housing 7.

Figure 3:
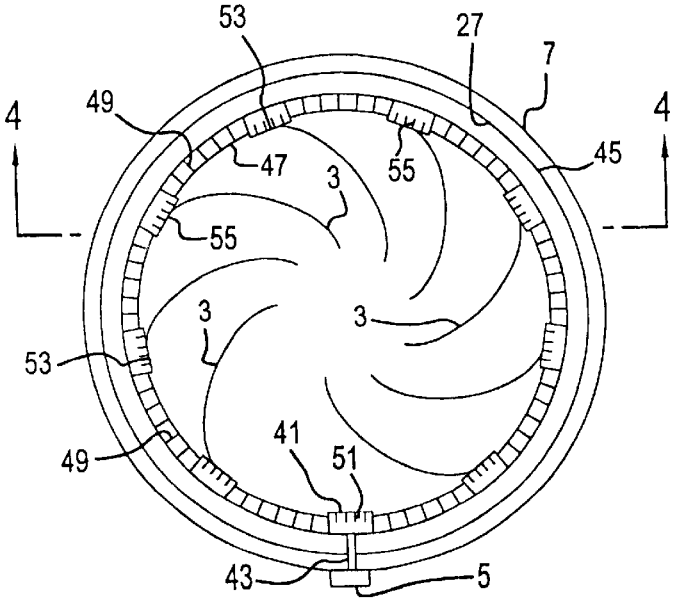
FIG. 3 is a top view of the fan device with the top grill removed.

Referring to FIGS. 3 and 4, dial 5 is connected by a shaft 43 to gear 41. A track 45 is rotatably connected along an interior circumference of the fan housing 7. The innermost edge 47 of the track 45 has teeth 49. Turning dial 5 causes rotation of gear 41. The teeth 51 of gear 41 mesh with the teeth 49 of track 45. When gear 41 is caused to rotate by dial 5, the teeth 51 of the gear 41 engage the teeth 49 of track 45 causing the track to rotate. The rotation of the track 45 engages teeth 55 of vane gears 53, which causes the vane gears to rotate. As shown in FIG. 3, a vane 3 is connected to each gear 53. Rotation of the dial 5 adjusts the vanes 3 between angles of 10 to 45 degrees.

In a preferred embodiment, a fan blade assembly 9 is a one-piece construction made of Lexan. In another embodiment, an aluminum hub is used with polycarbonate blades. Preferably, the fan blade assembly 9 has a central hub 21 from which three curved blades 23 extend as part of the one piece construction, as shown in FIG. 3. For fans utilizing a motor with larger horsepower, a fan blade assembly that has more than three blades may be used. The fan housing 7 is roto-molded and is made to withstand abuse. Preferably, the fan housing is cylindrical. Upper 31 and lower 33 grills protect the components within the fan housing 7 from damage due to foreign elements entering the fan housing. Handles 35 on the exterior surface 37 of the fan housing 7 provide an easy means for carrying and moving the fan 1.

A motor 11 drives the fan blade assembly 9. Shaft 29 connects the fan blade assembly 9 to the motor 11. Preferably, the motor 11 is a brushless 4 amp AC motor. In another embodiment, a brushless 10 amp AC motor may be used. Supports 25 connect the motor 11 to the inner surface 27 of the fan housing 7. The motor speed is controlled by a controller, such as a rotating dial 13, on the fan housing 7, as shown in FIG. 2. no The rotating dial 13 allows for adjusting the motor speed from 0 to 100%. Pressing a controller, such as "burst" button 15, located on the fan housing 7 instantly provides 100% motor speed. The fan motor 11 runs at full speed for as long as the "burst" button is depressed. Power cord 39 supplies power to the fan motor 11 from an external power source.

A stand, such as mounting yoke 17, is pivotally connected to opposite sides of the fan housing 7, allowing the fan 1 to be set at various angles. The fan 1 may also be inverted during transportation so that the fan is protected by the yoke 17. The stand may have a mounting hole to attach to an industry standard "baby" pins and outside pin diameter fits into industry standard "junior" stands. The stand also allows for placement of the fan on the ground. Employing a pivotal connection between the stand and the fan allows for tiltable operation of the fan.

While the invention has been described with reference to specific embodiments, modifications and variations of the invention may be constructed without departing from the scope of the invention.

We claim:

1. A fan apparatus, comprising:

a housing;

a fan blade assembly in the housing;

a motor connected to the fan blade assembly for driving the fan blade assembly; and an adjustable vane assembly connected to the housing for controlling a width of wind generated by the fan blade assembly, wherein the adjustable vane assembly comprises a flat circular track movably attached to an interior circumference of the housing, a plurality of teeth on the track, at least one primary gear disposed on the track for moving the track, a plurality of secondary gears disposed on the track, said plurality of secondary gears move with the track when the track is moved by the at least one primary gear, and an adjustable vane connected to each secondary gear and extending in a direction toward a center of the housing, said adjustable vane rotates in response to movement of the secondary gear.

2. The apparatus of claim 1 wherein the housing is cylindrical.

3. The apparatus of claim 1, further comprising:

a shaft connecting the motor and the fan assembly;

and wherein the fan blade assembly comprises a central hub connected to the shaft and a plurality of fan blades connected to the hub.

4. The apparatus of claim 3, wherein the fan blade assembly is of a one-piece construction.

5. The apparatus of claim 4, further comprising:

a controller connected to the at least one primary gear for moving the at least one primary gear to adjust the adjustable vanes.

6. The apparatus of claim 5, wherein the controller is located on the housing.

7. The apparatus of claim 1, further comprising:

a controller connected to the motor for adjusting the motor speed.

8. The apparatus of claim 7, wherein the controller is located on the housing.

9. The apparatus of claim 1, further comprising:

a controller connected to the motor for instantly bumping a motor speed to a highest setting when a button is depressed.

10. The apparatus of claim 9, wherein the controller is located on the housing.

11. The apparatus of claim 1, further comprising:

a stand pivotally connected to the housing for supporting the fan apparatus and for angularly adjusting the fan apparatus.

12. The apparatus of claim 1, wherein the housing is roto-molded.

13. A method of controlling fan generated wind, comprising:

providing a fan housing;

generating wind with a fan blade assembly in the fan housing;

driving the fan assembly by a motor;

adjusting the speed of the motor for controlling a speed of the generated wind;

adjusting wind flow with an adjustable vane assembly in the fan housing, wherein the adjustable vane assembly comprises a plurality of adjustable vanes; and wherein the adjusting wind flow comprises adjusting the angle between the plurality of adjustable vanes and the generated wind for controlling width of the generated wind.

14. The method of claim 13, wherein the adjusting the speed of the motor comprises operating a controller connected to the motor for increasing or decreasing the speed of the motor.

15. The method of claim 13, wherein the adjusting the speed of the motor comprises operating a controller connected to the motor for instantly increasing the speed of the motor to the maximum speed.

16. The method of claim 13, further comprising:

connecting the motor to a lighting dimmer board; and adjusting the speed of the motor from the lighting dimmer board for controlling the speed of the generated wind.

* * * * *